US011896128B2

(12) United States Patent
Leng

(10) Patent No.: US 11,896,128 B2
(45) Date of Patent: Feb. 13, 2024

(54) SOFA BED

(71) Applicant: NEW-TEC INTEGRATION (XIAMEN) CO., LTD., Fujian (CN)

(72) Inventor: Luhao Leng, Fujian (CN)

(73) Assignee: NEW-TEC INTEGRATION (XIAMEN) CO., LTD., Xiamen (CN)

( * ) Notice: Subject to any disclaimer, the term of this patent is extended or adjusted under 35 U.S.C. 154(b) by 42 days.

(21) Appl. No.: 17/575,539

(22) Filed: Jan. 13, 2022

(65) Prior Publication Data

US 2022/0225780 A1 Jul. 21, 2022

(30) Foreign Application Priority Data

Jan. 18, 2021 (CN) ..... 202110062622.7

(51) Int. Cl.
*A47C 17/16* (2006.01)
*A47C 27/06* (2006.01)
(Continued)

(52) U.S. Cl.
CPC ..... *A47C 17/162* (2013.01); *A47C 7/347* (2013.01); *A47C 23/002* (2013.01);
(Continued)

(58) Field of Classification Search
CPC ... A47C 17/162; A47C 17/1753; A47C 17/17; A47C 23/002; A47C 27/07; A47C 27/064; A47C 27/20; A47C 27/0456; A47C 7/34; A47C 17/37; A47C 17/1756; A47C 1/03266; A47C 1/03272; A47C 17/04; A47C 17/16; A47C 17/23; A47C 7/347; A47C 7/448; A47C 27/065; A47C 23/005; A47C 7/144; A47C 23/0438; A47C 23/00;
(Continued)

(56) References Cited

U.S. PATENT DOCUMENTS 5,528,778 A 6/1996 Shrock et al.
5,924,682 A * 7/1999 Bullard ..... A47C 23/32 267/103
(Continued)

FOREIGN PATENT DOCUMENTS

CA 2758906 A1 * 10/2010 ..... A47C 27/04

OTHER PUBLICATIONS

"Strap." Merriam-Webster, Merriam-Webster, www.merriam-webster.com/dictionary/strap.*

*Primary Examiner* — Justin C Mikowski
*Assistant Examiner* — Madison Emanski
(74) *Attorney, Agent, or Firm* — Perkins Coie LLP

(57) ABSTRACT

A sofa bed includes: a plurality of elastic modules; a body frame having slide rails arranged thereon; and armrest frames disposed at two sides of the body frame along a longitudinal direction of the body frame, respectively. The slide rails on the body frame are configured to enable the plurality of elastic modules to be mounted on the body frame from an outside of the body frame and to slide thereon to predetermined mounting positions, such that the body frame at one side facing the user is provided with the plurality of elastic modules. The angle between the seat and the backrest portion can be locked for improved operation. The elastic modules, which can be easily installed and uninstalled, can improve the comfort of the sofa bed.

24 Claims, 20 Drawing Sheets

(51) Int. Cl.

| | |
|---|---|
| ***A47C 7/34*** | (2006.01) |
| ***A47C 27/07*** | (2006.01) |
| ***A47C 23/00*** | (2006.01) |
| ***A47C 27/00*** | (2006.01) |
| ***A47C 27/04*** | (2006.01) |

(52) U.S. Cl.
CPC ..... *A47C 27/065* (2013.01); *A47C 27/07* (2013.01); *A47C 7/34* (2013.01); *A47C 27/00* (2013.01); *A47C 27/04* (2013.01); *A47C 27/06* (2013.01)

(58) Field of Classification Search
CPC ..... A47C 7/0274; A47C 27/00; A47C 27/06; F16B 12/28
See application file for complete search history.

(56) References Cited

U.S. PATENT DOCUMENTS

| | | | | |
|---|---|---|---|---|
| 6,209,154 | B1 * | 4/2001 | Huang | A47C 17/162 297/354.13 |
| 9,259,093 | B2 * | 2/2016 | Leng | A47C 17/1756 |
| 10,512,337 | B2 | 12/2019 | Leng | |
| 10,869,559 | B2 * | 12/2020 | Leng | A47C 27/0456 |

* cited by examiner

C-C

SOFA BED

PRIORITY CLAIM

This application claims the benefit of Chinese Patent Application No. 202110062622.7, filed Jan. 18, 2021, which is incorporated by reference.

FIELD

The present disclosure relates to the design of furniture, and specifically to a sofa bed.

BACKGROUND

The need of the consumer for household furniture presents a trend of diversification, wherein sofa beds have already become a type of popular furniture product. Conventional sofa beds have certain drawbacks, such as for example, the switching of the conventional sofa beds between sofa and bed positions is not so easily achieved. Conventional sofa beds are also not necessarily stable in the sofa position. The angle between the seat and the backrest may vary, which affects user comfort.

Therefore, there is a need for improved folding sofa beds.

SUMMARY

A sofa bed is provided which is easily switchable between two in-use positions and easy to operate. Furthermore, in a predetermined switching procedure and a predetermine use procedure, an angle between a seat portion and a backrest portion can be locked to improve the reliability of the operation. In the switching operation, by allowing a pin to slide in a sliding groove in an extension direction having a transverse component and a vertical component, the switching operation can be achieved quickly and easily. Furthermore, the sofa bed may be provided with a plurality of detachable elastic modules which are simple to mount and convenient to operate. Thus, the user may manually mount them to obtain a sofa bed having a better degree of comfort.

In one aspect a sofa bed includes:

a plurality of elastic modules each comprising a conical spring and configured to receive a spring bracket of the conical spring;

a body frame comprising a plurality of supports arranged perpendicular to each other, the supports at one side facing a user being provided with slide rails each engageable with a bottom of the respective spring bracket to allow the plurality of elastic modules to slide on the slide rails; and armrests disposed at two sides of the body frame along a longitudinal direction of the body frame, respectively, wherein the slide rails on the body frame are configured to enable the plurality of elastic modules to be mounted on the body frame from an outside of the body frame and to slide thereon to predetermined mounting positions, such that the body frame at one side facing the user is arranged densely with the plurality of elastic modules.

The sofa bed may be provided with a plurality of removable elastic modules that allow simple installment and easy operation. In the circumstance, a user can manually install those elastic modules to obtain a more comfortable sofa bed.

In one embodiment the spring bracket of each of the elastic modules comprises a base including spring mounting seats, each of the spring mounting seats having a spring fixing part for fixing an end of the conical spring.

In another embodiment the spring bracket of each of the elastic module further comprises:

an end cap disposed opposite to the respective spring mounting seat and cooperating with the latter to hold the conical spring, wherein the end cap abuts against an end of the conical spring opposite to the other end thereof fixed in the spring mounting seat; and a set or a plurality of sets of flexible straps, each set of flexible straps comprising a plurality of flexible straps spaced apart and distributed evenly between a respective pair of the spring mounting seat and the end cap, the flexible straps disposed outside the conical spring when the conical spring is held between the respective pair of the spring mounting seat and the end cap.

According to a further preferable embodiment of the present invention, each of the elastic modules further comprises a cover wrapping the conical spring of the elastic module.

The conical spring may be mounted within the spring bracket in a predetermined initial compressive force.

In view of the above solutions, the elastic modules have a favorable structure, which can maintain stability and offer certain elasticity, thus providing a better user experience.

In another embodiment the plurality of slide rails are disposed on supports extending in the longitudinal direction, each of the slide rails having an end opened to receive the elastic module.

The plurality of slide rails may be disposed on supports extending in a transverse direction, each of the slide rails having an end opened to receive the elastic module.

The plurality of slide rails may comprise a plurality of longitudinal slide rails disposed on supports extending in the longitudinal direction and a plurality of transverse slide rails disposed on supports extending in a transverse direction, and the longitudinal slide rails and the transverse slide rails are connected to each other at intersections thereof, enabling switching of the elastic modules in slide rails.

In another embodiment the transverse slide rails are disposed in a middle of the body frame in the longitudinal direction, ends of the transverse slide rails are opened to receive the elastic modules from an outside of the body frame, and the plurality of slide rails are configured to cause the plurality of elastic modules to enter into the transverse slide rails on the body frame from the ends of the body frame and to be switched to the respective longitudinal slide rails at the intersections of the transverse slide rails and the longitudinal slide rails.

In light of the above solutions, it is convenient for a user to install or uninstall the elastic modules as specifically required, and the assembling manner can be varied with the dimensions of the sofa bed.

In another embodiment the body frame comprises a seat and a backrest disposed adjacent to each other, the seat and the backrest configured to be folded or unfolded around a locking mechanism to switch the body frame between a bed configuration and a sofa configuration, and the armrests each are formed thereon with a slideway to guide movement of the locking mechanism, and wherein the body frame comprises the locking mechanism configured to lock the backrest relative to the seat in a predetermined angle when the sofa bed is configured as pivoting the backrest and the seat around the locking mechanism relative to each other, and the armrests are connected via the locking mechanism to the body frame, to cause, in a locked state, a part structure of the locking mechanism to drive the body frame to displace under the guidance of the slideway.

The locking mechanism may comprise:

a seat connecting rod attached to a transverse edge of the seat and extending along the transverse edge;

a backrest connecting rod attached to a transverse edge of the backrest located at the same side as the transverse edge of the seat and extending along the transverse edge of the backrest; and a pivot connecting the seat connecting rod and the backrest connecting rod, to cause the backrest and the seat to pivot relative to each other.

In this embodiment, the angle between the seat and the backrest can be locked such that the operation reliability can be improved; during switching, the pin is slidable within the chute along the extending direction of the transverse component or vertical component, thereby enabling the switch operation to be fulfilled quickly and effortlessly.

The body frame may be configured to release locking between the seat connecting rod and the backrest connecting rod when the seat in a locked state is operated to pivot towards the backrest.

In another embodiment one of the seat connecting rod and the backrest connecting rod is provided with a ratchet, the other of the seat connecting rod and the backrest connecting rod is provided with a pawl, and the ratchet and the pawl cooperate with each other to lock the backrest relative to the seat in a predetermined angle.

The ratchet at an outer edge I may be provided with a recess recessed inwards in a radial direction of the ratchet, the pawl is provided with a protrusion corresponding with the recess, and the protrusion is configured to cause the protrusion to engage the recess, thereby locking the backrest and the seat.

The seat and the backrest may be rectangular.

A side of the seat extending in the longitudinal direction may be disposed adjacent to a side of the backrest extending in the longitudinal direction.

The body frame may be configured to lock the backrest relative to the seat in a plurality of predetermined angles.

The body frame may include a driven beam which is pivotably connected at one end to the armrest frame and at the one end to the backrest.

In another embodiment the armrest frame comprises an armrest frame body substantially of a U-shape and a reinforcement transverse beam connected between two legs of the armrest frame body, and the slideway is formed on the reinforcement transverse beam.

The locking mechanism may be provided with a pin extending towards the outside of the body frame, the slideway is a chute formed on the reinforcement transverse beam, an end thereof is positioned to be higher than the other end of the slideway, and the end is opened towards an upper side of the armrest frame to receive a pin of the locking mechanism.

The reinforcement transverse beam may be provided with a slide rod, and the locking mechanism is provided with a slide sleeve configured to be sleeved on the slide rod and slide along the slide rod.

The reinforcement transverse beam at a lower side may be provided with a slide rod which, together with the reinforcement transverse beam, defines a chute.

In another embodiment the reinforcement transverse beam has a section of a concave shape, and the pin at an outer end is provided with a protrusion fitting with the concave shape.

The sofa bed may include a bottom support structure supported below the backrest and the seat and connected fixedly to the two armrests.

BRIEF DESCRIPTION OF THE DRAWINGS

Reference may be made to preferred embodiments shown in the figures to enable better understanding of the above and other objects, features, advantages and functions of the present invention. The same or like reference numerals in the figures denote the same or like parts. Those skilled in the art should appreciate that the figures are intended to schematically illustrate the preferred embodiments of the present invention, and not intended to limit the scope of the present invention, and all parts shown in the figures are not drawn to scale.

DETAILED DESCRIPTION OF EMBODIMENTS

Figure 1:
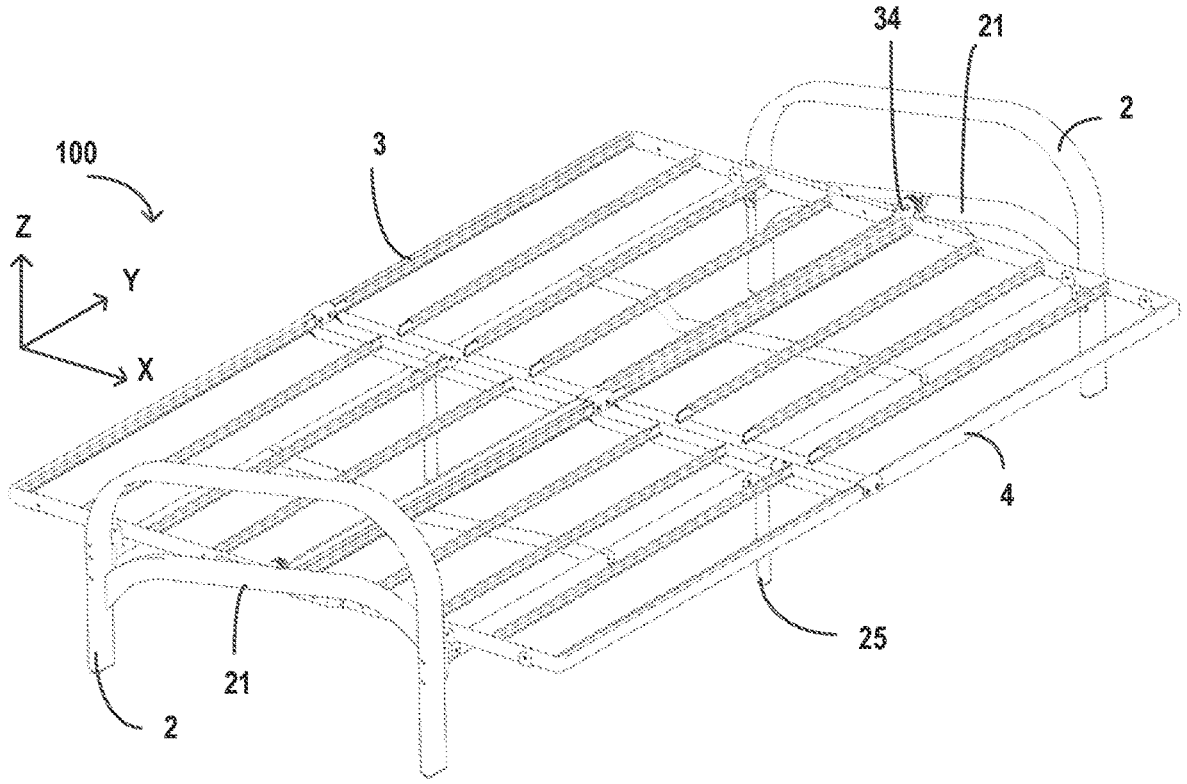
FIG. 1 is a perspective schematic view of a main body frame of a sofa bed arranged in a bed state.
Figure 2:
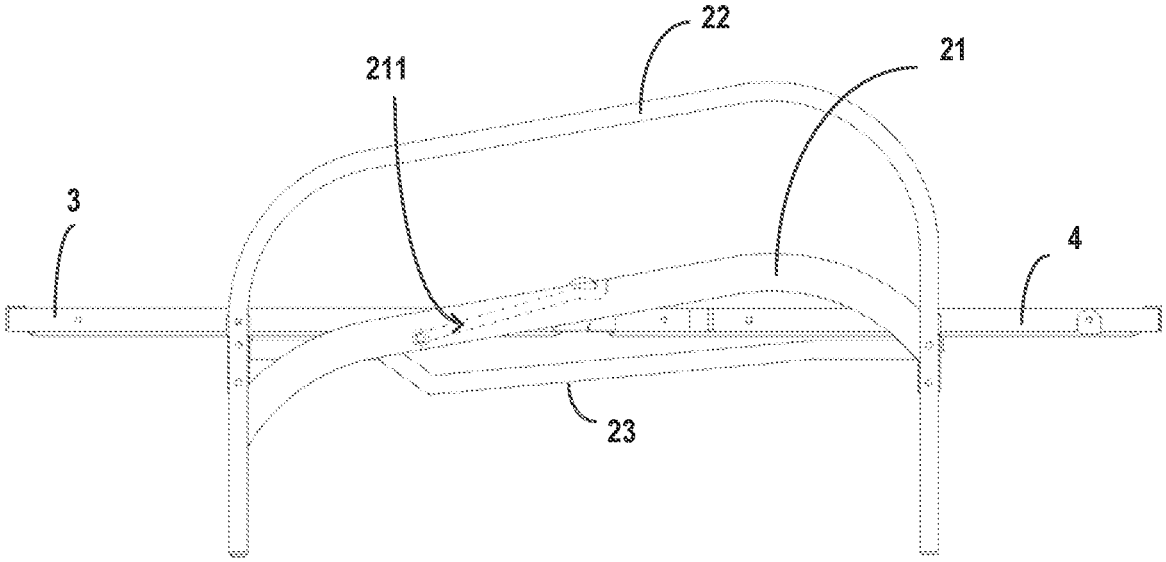
FIG. 2 is a side view of the sofa bed shown in FIG. 1.
Figure 3:
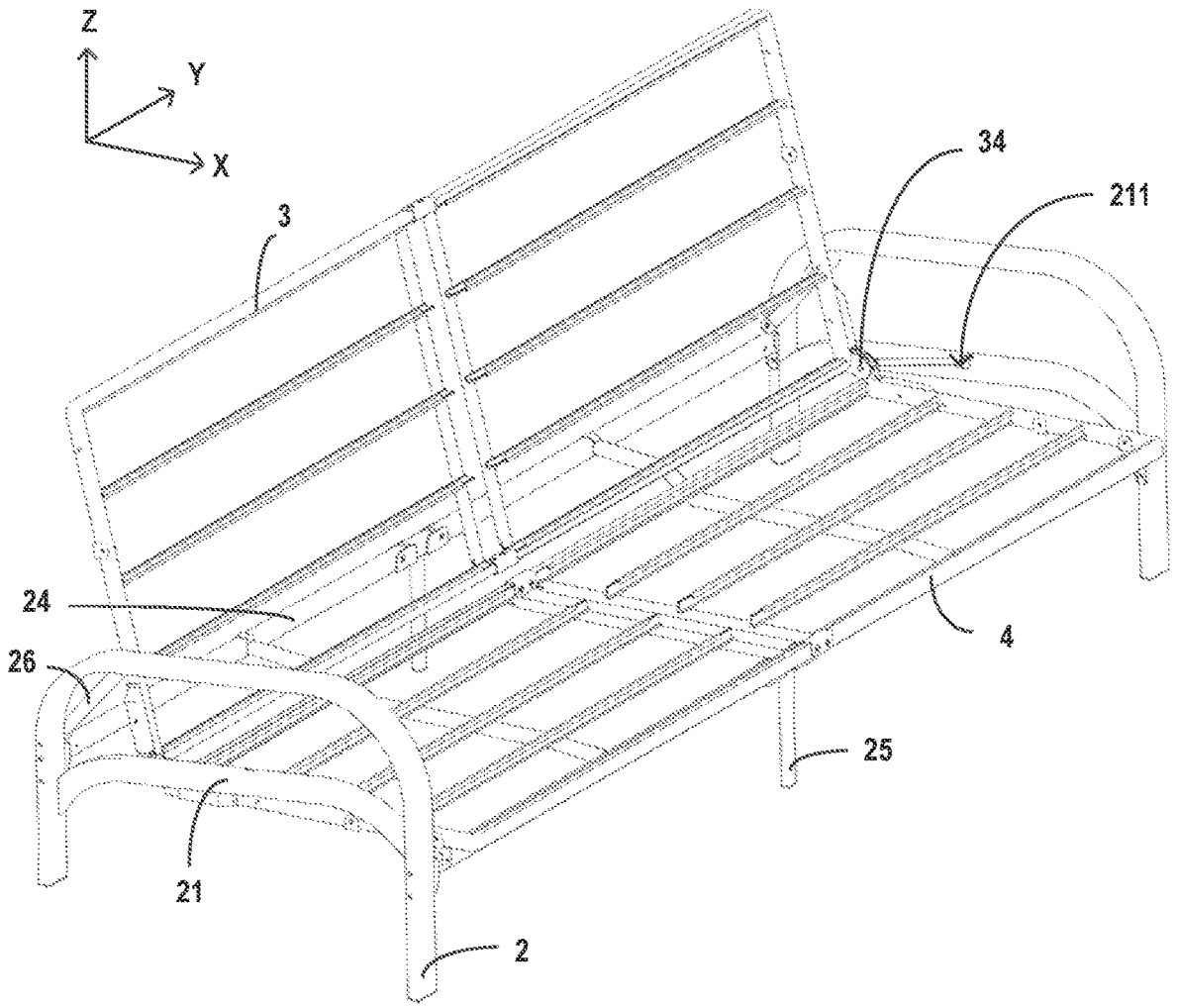
FIG. 3 is a perspective schematic view of the main body frame of FIG. 1 in a sofa state.
Figure 4:
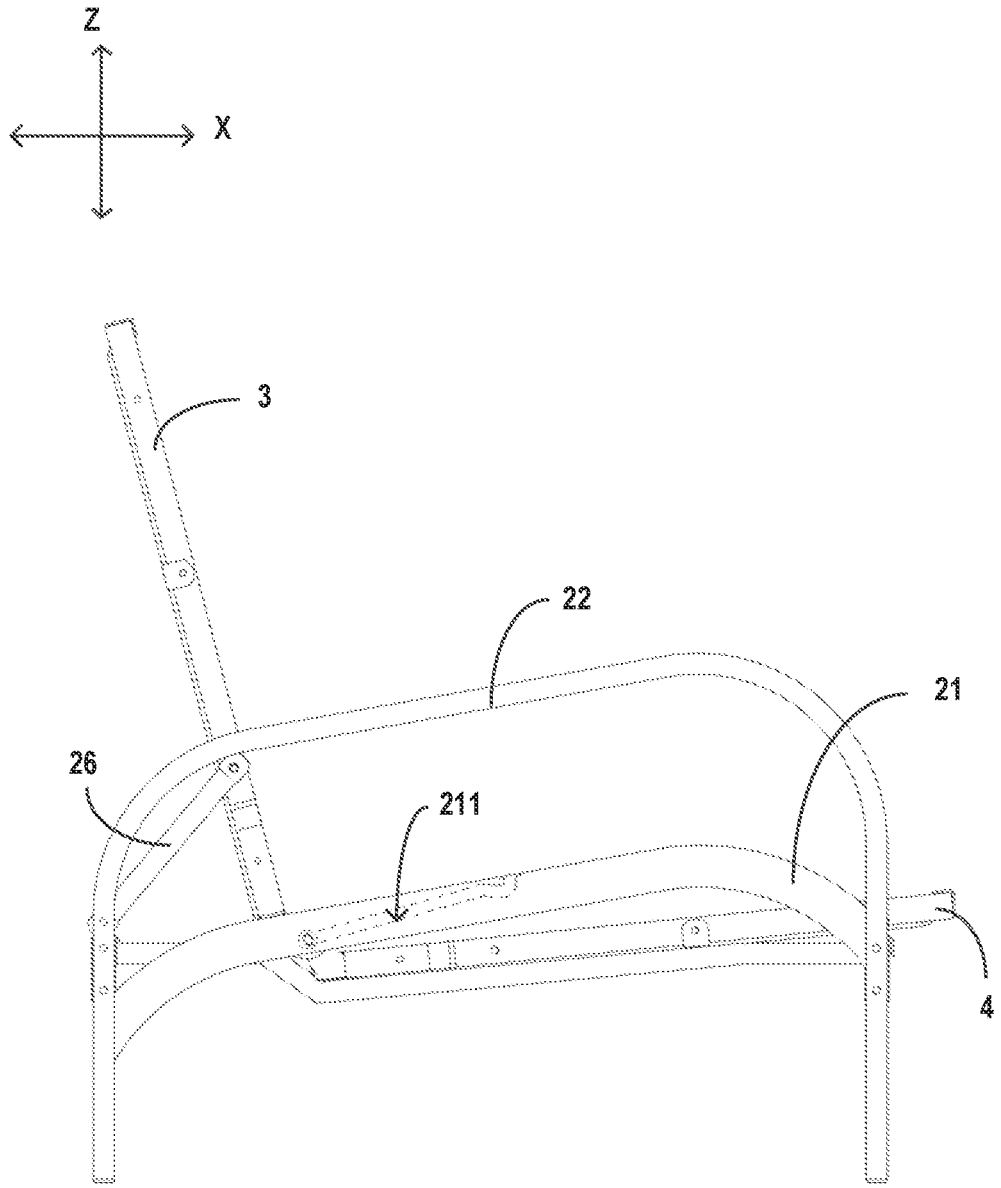
FIG. 4 is a side view of the sofa bed shown in FIG. 3.

Specific embodiments of the present prevention will now be described in detail with reference to the figures. What are described here are only preferred embodiments according to the present invention. Those skilled in the art can implement other embodiments of the present invention on the basis of the preferred embodiments, and said other embodiments also fall within the scope of the present invention.

"Transverse direction" and "longitudinal direction" refer to absolute directions, and respectively two directions perpendicular to each other in a horizontal plane, wherein the transverse direction is shown by X in the figures, and the longitudinal direction is shown by Y in the figures. "Widthwise direction" and "lengthwise direction" refer to relative directions relative to a rectangle formed by a seat portion and a backrest portion, but the lengthwise direction always coincides with the longitudinal direction Y, the widthwise direction coincides with the transverse direction X only when the seat portion and/or backrest portion are placed horizontally. A height direction is an absolute vertical direction and shown by Z in the figures.

Referring to FIG. 1 through FIG. 6F a sofa bed has a main body frame 100 which includes a seat portion 4, a backrest portion 3, a seat portion connecting rod 41, a backrest portion connecting rod 31, and two armrest frames 2. The seat portion 4 and the backrest portion 3 are both formed as a rectangular structure, which may be a rectangular frame structure or a rectangular plate-like structure. A longitudinal edge of the seat portion 4 and a longitudinal edge of the backrest portion 3 are butted together.

Figure 5:
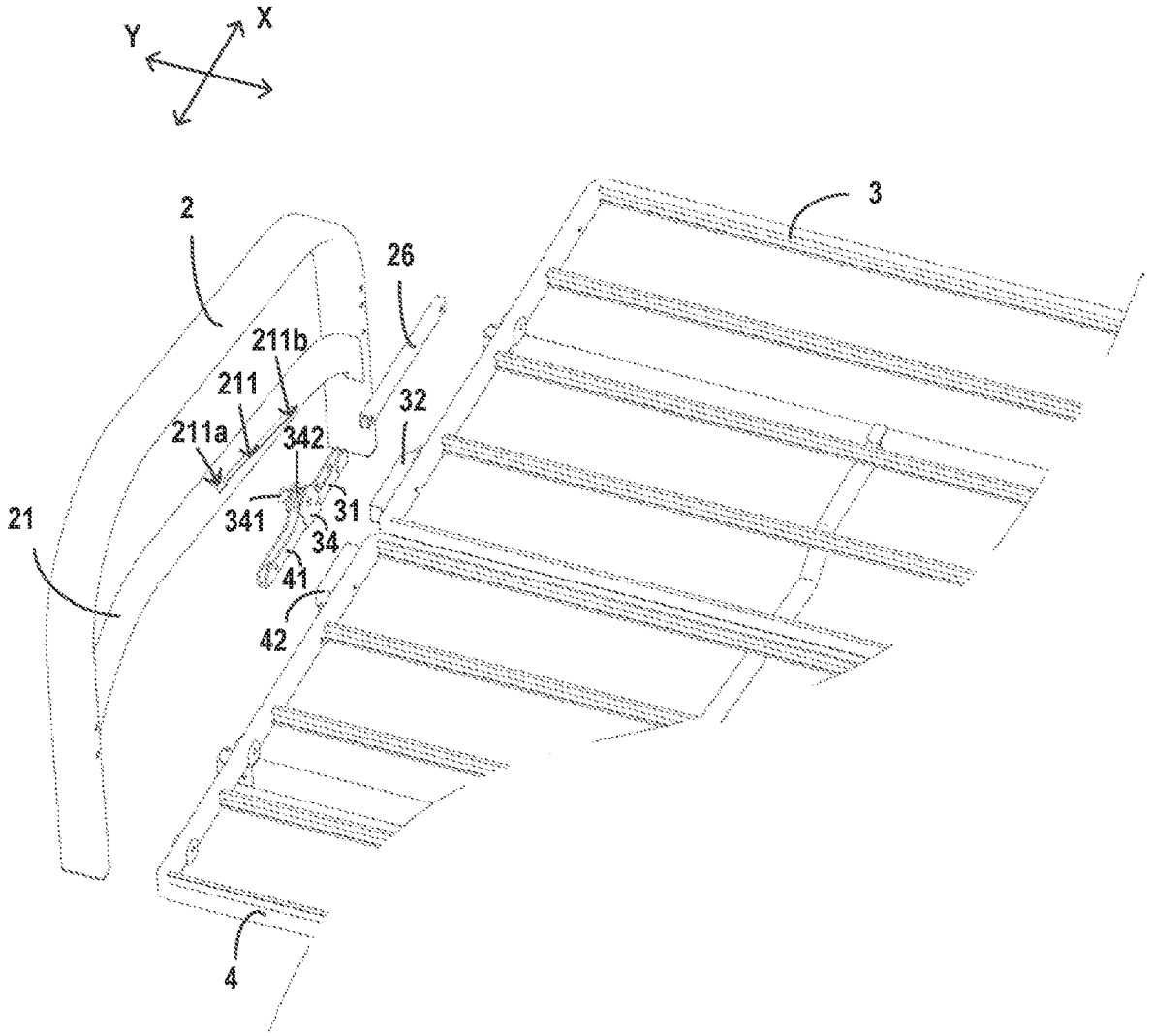
FIG. 5 is an exploded schematic view of a junction of a seat portion and a backrest portion.

As shown in FIG. 5 the seat portion connecting rod 41 is fixed on a widthwise edge of the seat portion 4, the backrest portion connecting rod 31 is fixed on a widthwise edge of the backrest portion 3, and the seat portion connecting rod 41 and the backrest connecting rod 31 are connected together in a way that they are pivotable relative to each other. When the seat portion connecting rod 41 and the backrest portion connecting rod 31 pivot relative to each other, an angle between them increases or decreases, and is less than or equal to 180°.

The two armrest frames 2 are provided at both ends of the seat portion 4 and the backrest portion 3 in the longitudinal direction, and each of the armrest frames 2 is provided with a slideway that opens toward the backrest portion 3 and the seat portion 4 and partially extends in the transverse direction. In FIG. 5 the slideway is a sliding groove 211, and a rear end 211*b* of the sliding groove 211 is positioned lower than a front end 211*a* of the sliding groove 211.

The exploded schematic view of the pivotal connection of the seat portion 4 and the backrest portion 3 is shown in FIG. 5. Referring to FIG. 5, the seat portion connecting rod 41 and the backrest portion connecting rod 31 are engaged with each other at a locking mechanism 34, and the locking mechanism 34 has a pin 341 protruding from a side facing the armrest. The front end 211*a* of the sliding groove 211 is provided with an upward opening, so that the pin 341 can enter into the sliding groove 211 from the front end 211*a* of the sliding groove 211 and slide in the sliding groove 211. A special-shaped gear and a gear matching claw are provided at the locking mechanism 34, and they are respectively disposed on the seat portion connecting rod 41 and the backrest portion connecting rod 31. The special-shaped gear is for example a ratchet wheel 342, wherein the edge of the ratchet 342 is provided with a recessed portion that is recessed in a radial direction of the ratchet 342. The gear matching pawl is provided with a protruding portion that mates with the recessed portion. The recessed portion and the protruding portion are positioned such that when the backrest portion 3 and the seat portion 4 are located at a predetermined obtuse angle, the protruding portion is embedded or inserted in the recessed portion to achieve locking. The seat portion 4 is provided with a seat portion insertion sleeve 42 for accommodating the seat portion connecting rod 41, and the backrest portion 3 is provided with a backrest portion insertion sleeve 32 for accommodating the backrest portion connecting rod 31.

Furthermore, each armrest frame 2 includes an armrest frame body 22 and a reinforcing transverse beam 21, wherein the sliding groove 211 is disposed on the reinforcing transverse beam 21, and an extension direction of the reinforcing transverse beam 21 coincides with that of the sliding groove 21, i.e., the rear end 211*b* of the reinforcing transverse beam 21 is also positioned lower than the front end 211*a* of the reinforcing transverse beam 21. The armrest frame body 22 further includes two upright columns extending in the vertical direction and a body transverse beam connected at the tops of the two upright columns. The reinforcing transverse beam is connected to the middle of the two upright columns and is parallel to the body transverse beam.

In addition to the armrest frame 2, the supporting and fixing structure of the sofa bed further includes a bottom supporting structure 24 which is disposed under the backrest portion 3 and the seat portion 4 and is fixedly connected to the two armrest frames 2. The bottom supporting structure 24 includes for example a bottom supporting structure longitudinal beam, a bottom supporting structure transverse beam 23 and legs 25. The sofa bed further includes a driven beam 26, one end of which is pivotally connected to the armrest frame 2, and the other end of which is pivotally connected to the backrest portion 3.

FIG. 6A-FIG. 6F show a process in which the main body frame 100 changes from a first in-use position (at which the sofa bed is used as a bed) to a second in-use position (at which the sofa bed is used as a sofa) and then returns back to the first in-used position.

Figure 6A:
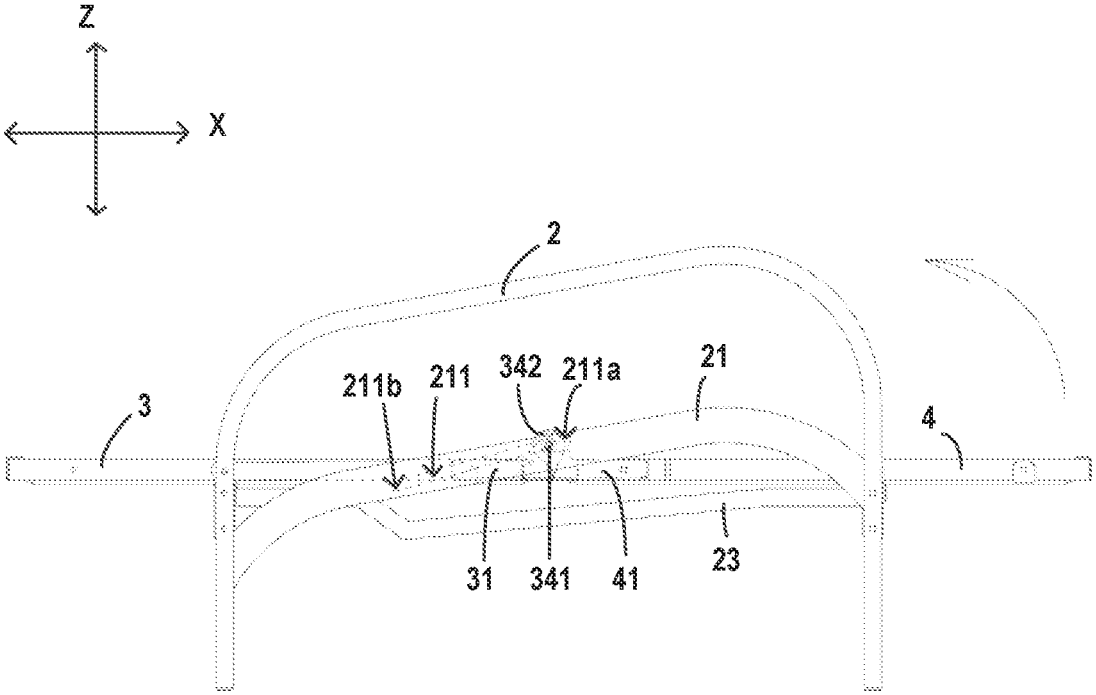
FIG. 6A-FIG. 6F are side views of the main body frame which sequentially show a process in which the sofa transitions from a first in-use state to a second in-use state, and then return back to the first in-use state.

First, referring to FIG. 6A, when the main body frame 100 is located at the first in-use position, the backrest portion 3 and the seat portion 4 are both horizontal, and the angle formed therebetween is a straight angle. The angle formed between the backrest portion connecting rod 31 and the seat portion connecting rod 41 is also substantially a straight angle, and the pivot axis of the locking mechanism 34 is substantially located adjacent to the front end 211*a* of the sliding groove 211. At this time, the backrest portion connecting rod 31 and the seat portion connecting rod 41 are not locked, thereby allowing the seat portion 4 to be operated to pivot toward a position where the angle between the seat portion 4 and the backrest portion 3 is reduced. The direction of the pivoting is shown by an arrow in FIG. 6A.

Figure 6B:
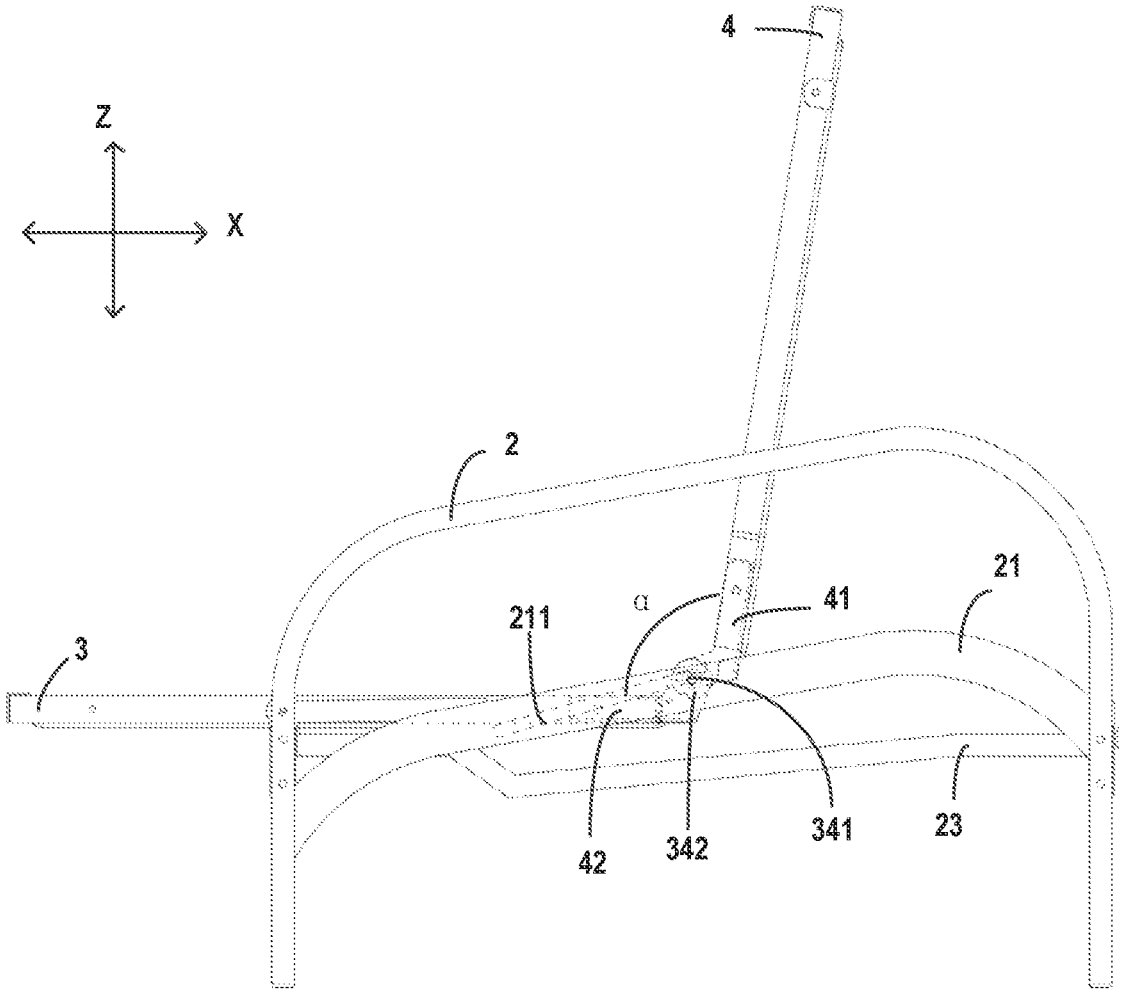

To adjust the main body frame 100 to the second in-use position, the seat portion 4 can be pivoted in the direction shown by the arrow in FIG. 6A, to a position shown in FIG. 6B. At the position shown in FIG. 6B, the pivoting between the backrest portion connecting rod 31 and the seat portion connecting rod 41 is locked. Specifically, for example, the locking mechanism 34 may be provided with a special-shaped ratchet 342 and a special-shaped pawl which have shapes matching to each other. The special-shaped ratchet 342 and the special-shaped pawl are shaped to snap fit together at the position shown in FIG. 6B to prevent the seat portion 4 from further rotating relative to the backrest portion 3. At this time, the angle between the seat portion 4 and the backrest portion 3 is a, which is an obtuse angle. The "predetermined obtuse angle" may be understood as a shown in FIG. 6B.

Figure 6C:
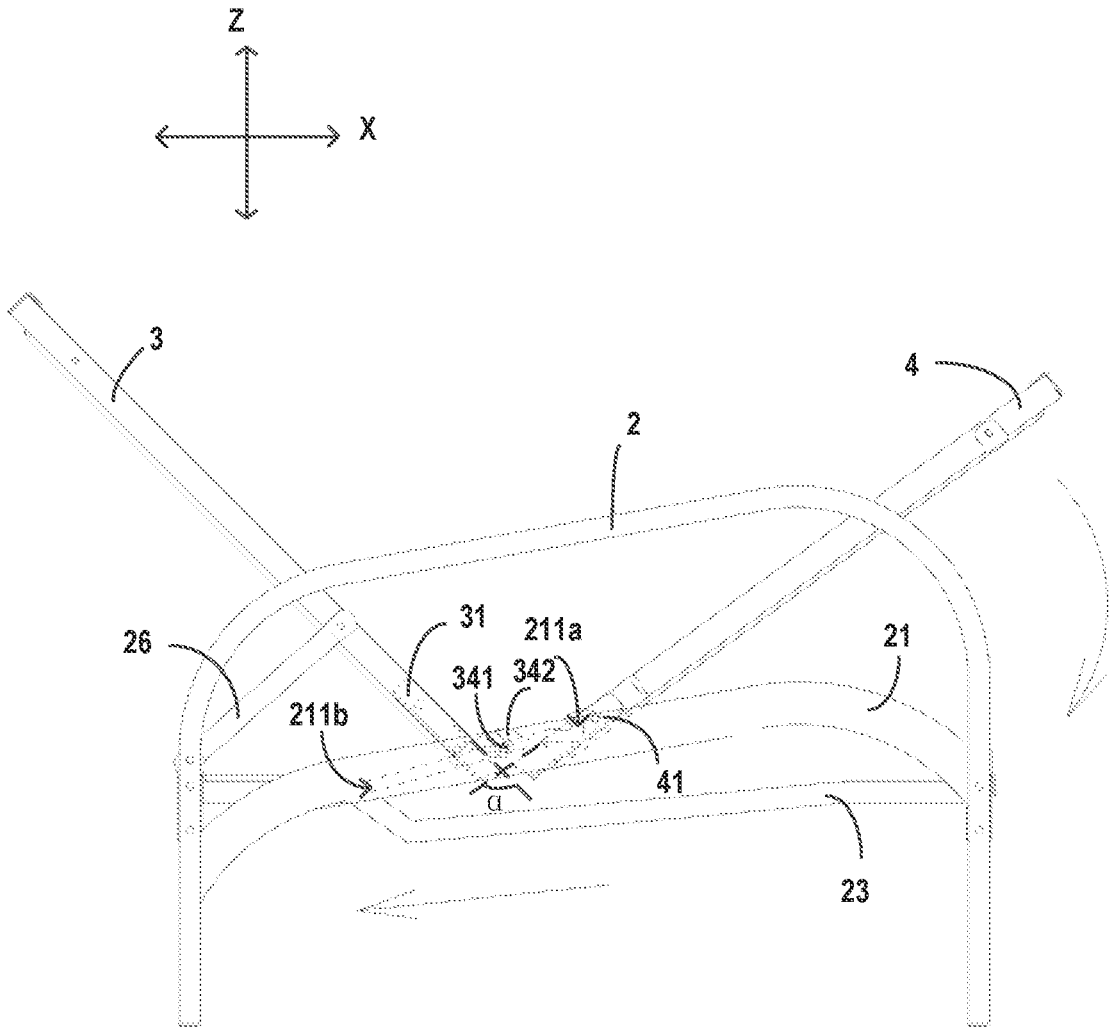

At this time, the pin 341 at the locking mechanism 34 can enter into the sliding groove 211 from the front end 211*a* of the sliding groove 211. Then, as shown in FIG. 6C, the seat portion 4 may be pressed down along an arc-shaped arrow, and meanwhile the pin 341 can drive the combination of the backrest portion 3 and the seat portion 4 to slide in a direction indicated by a straight arrow in FIG. 6C. After this operation, the combination of the backrest portion 3 and the seat portion 4 can reach the second in-use position as shown in FIG. 6D.

Figure 6D:
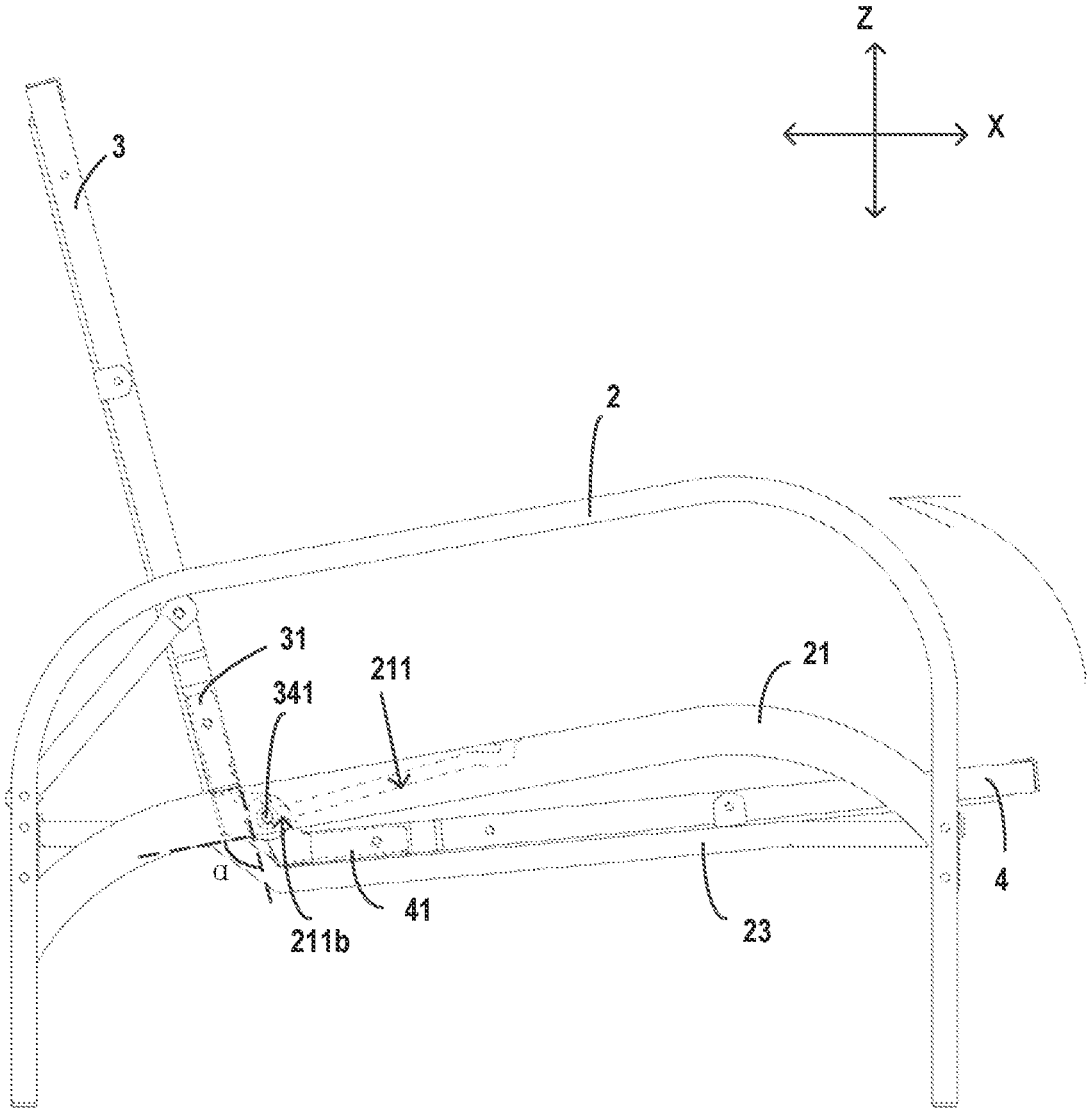

In the structure shown in FIG. 6B through FIG. 6D, the backrest portion connecting rod 31 and the seat portion connecting rod 41 are locked to each other at the locking mechanism 34, and the angle between the backrest portion 3 and the seat portion 4 is always a.

To change the main body frame 100 from the second in-use position to the first in-use position, the seat portion 4 can be manually operated to further pivot toward the backrest portion 3 in the direction indicated by the arrow as shown in FIG. 6D. The action for example can make the protruding portion of the pawl disengage from the recessed portion of the ratchet, thereby releasing the locking between the seat portion connecting rod 41 and the backrest portion connecting rod 31.

Figure 6E:
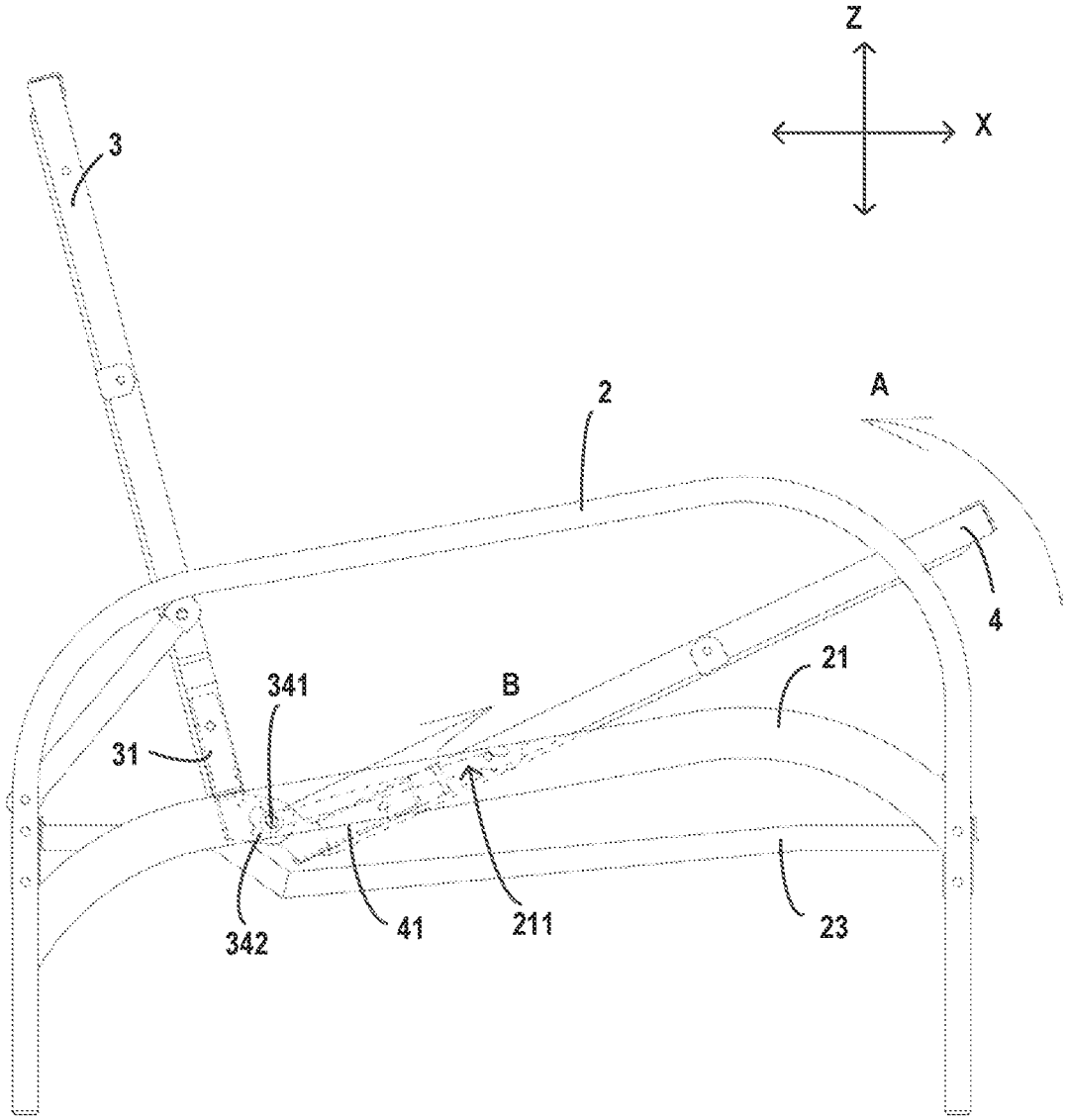
Figure 6F:
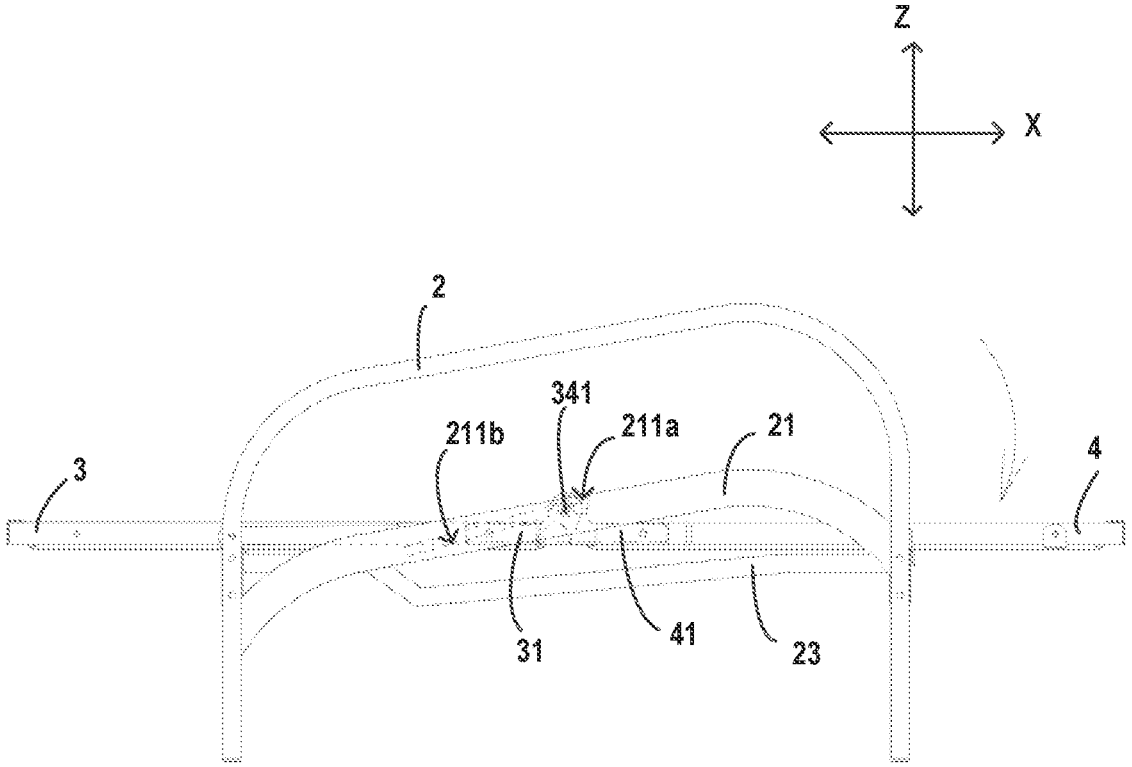

Referring to FIG. 6E, after the seat portion 4 is pivoted in the direction indicated by arrow A, the locking between the seat portion connecting rod 41 and the backrest portion connecting rod 31 is released. After the unlocking, the pin 341 is slid in the sliding groove 211 toward the front end 211*a* in the direction indicated by the arrow B, thereby driving the backrest portion 3 and the seat portion 4 to reach the position shown in FIG. 6F, so that the main body frame 100 returns to the first in-use position.

Figure 7A:
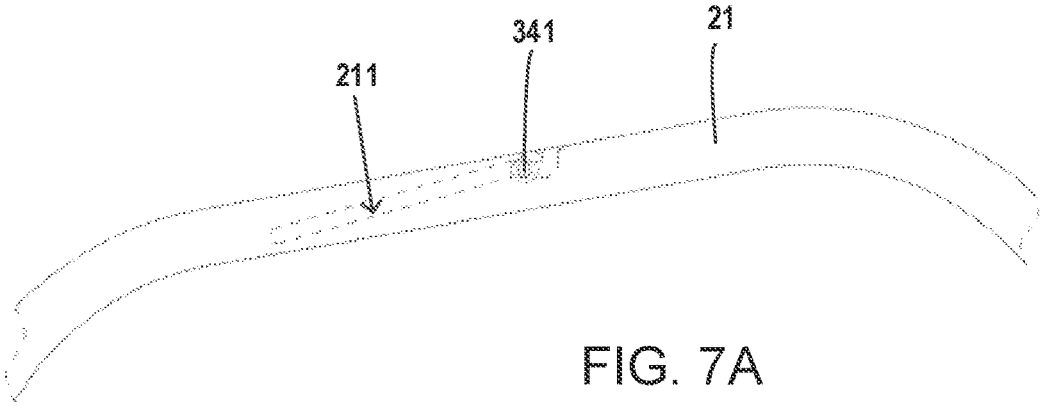
FIG. 7A shows a schematic diagram of a sliding groove.
Figure 7B:
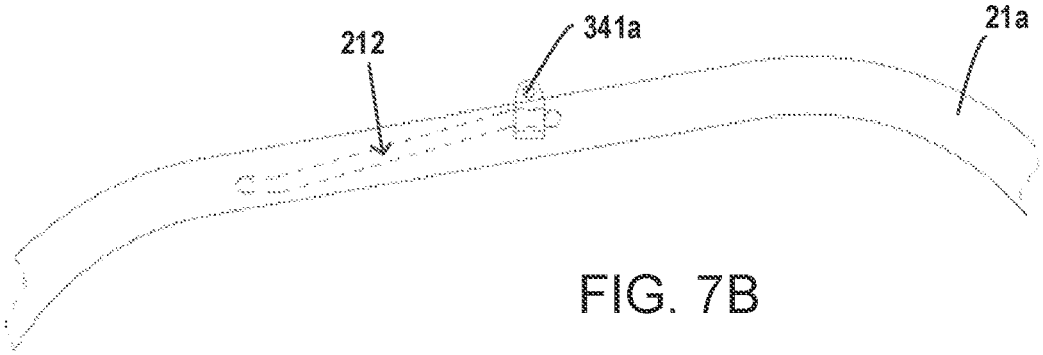
FIG. 7B-FIG. 7D are alternative implementations of the sliding groove shown in FIG. 7A.
Figure 7C:
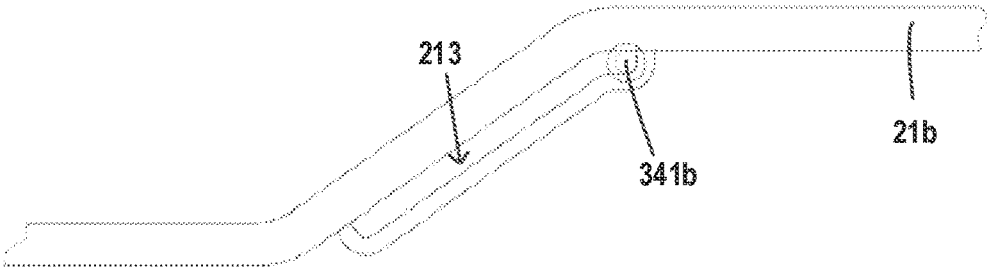
Figure 7D:
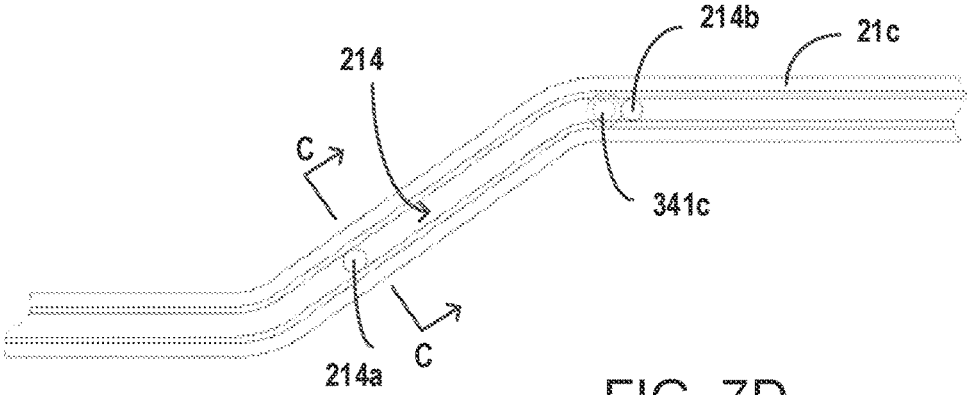

FIG. 7A shows details of the sliding groove 211 in FIG. 1 through FIG. 6F. In FIG. 7A, the sliding groove 211 is a groove structure formed on the reinforcing transverse beam 21 itself of the armrest frame 2. FIG. 7B through FIG. 7D show alternative embodiments of FIG. 7A.

In the embodiment shown in FIG. 7B, the reinforcing transverse beam 21*a* is provided with a sliding rod 212, and a sliding sleeve 341*a* is fixed at the locking mechanism of the backrest portion connecting rod and the seat portion connecting rod to engage with and slide on the sliding rod 212.

In the embodiment shown in FIG. 7C, a sliding rod is disposed under the reinforcing transverse beam 21*b*, the sliding rod and the lower edge of the reinforcing transverse beam 21*b* jointly define a sliding groove 213, and a pin 341*b* fixed at the locking mechanism of the backrest portion connecting rod and the seat portion connecting rod can engage with and slide in the sliding groove 213.

Figure 7E:
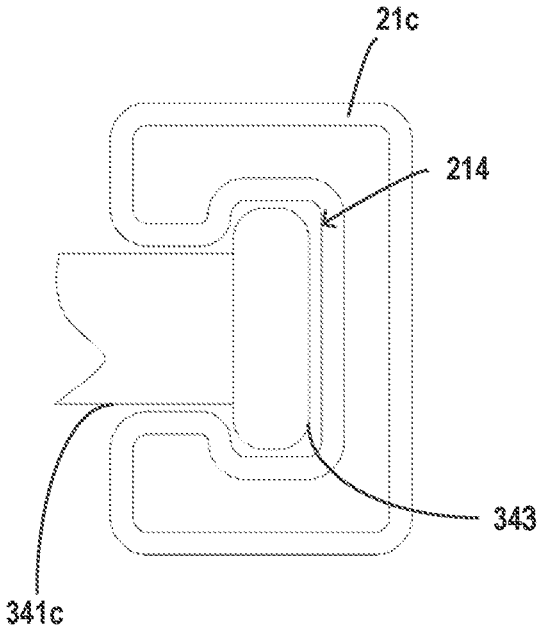
FIG. 7E is a cross-sectional view taken along line C-C indicated in FIG. 7D, wherein hatching lines are omitted in FIG. 7E for a clearer illustration purpose.

In the embodiment shown in FIG. 7D, the reinforcing transverse beam 21*c* is a special-shaped beam having a cross section as shown in FIG. 7E. Referring to FIG. 7E, the cross-section of the reinforcing transverse beam 21*c* is in a shape of a channel or U and a pin 341*c* is fixed at the locking mechanism of the backrest portion connecting rod and the seat portion connecting rod, wherein a projection 343 having a shape that can mate with the U shape is provided at an outer end of the pin 341*c*, and the projection 343 can be adaptively received in the U-shaped beam so that the pin 341*c* can slide along the sliding groove 214 without disengaging from the sliding groove 214. Two stoppers are provided in the U-shaped beam, wherein a front stopper 214*b* can constitute the front end of the sliding groove 214, and a rear stopper 214*a* can constitute the rear end of the sliding groove 214.

Figure 8:
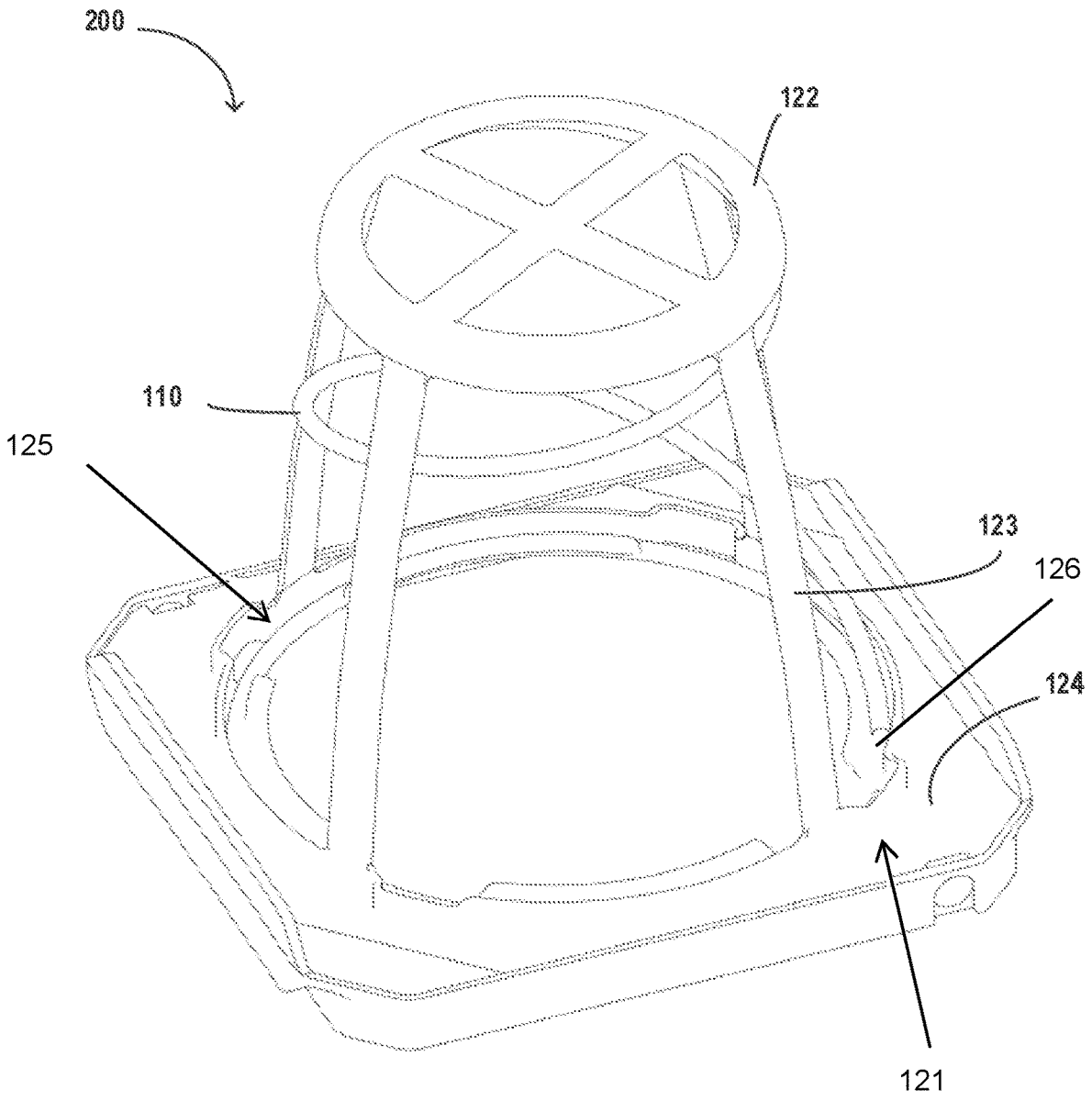
FIG. 8 is a schematic diagram of an elastic module of a sofa bed.

In addition to the above structure, the sofa bed may further include a plurality of elastic modules. FIG. 8 shows an example of an elastic module. Referring to FIG. 8, each of the elastic modules 200 includes a conical spring 110 and a spring bracket 121 accommodating the conical spring. The spring bracket 121 includes a base 124, an end cover 122 and one or more sets of flexible straps 123. The base includes a base of a spring mounting seat 125, and each spring mounting seat has a spring fixing portion 126 for fixing one end of the conical spring 110. The end cover 122 is arranged opposite to and cooperative with the corresponding spring mounting seat to hold the conical spring 110, wherein the end cover 122 abuts against the other end of the conical spring 110 opposite to the end fixed in the spring mounting seat. Each set of flexible straps 123 includes a plurality of flexible straps spaced apart and evenly arranged between a corresponding pair of spring mounting seat and end cap. When one conical spring 110 is retained between the corresponding pair of spring mounting seat and end cover 122, the flexible straps 123 are located outside the conical spring 110. Alternatively, the sofa bed further includes a cover covering the conical springs.

Figure 9:
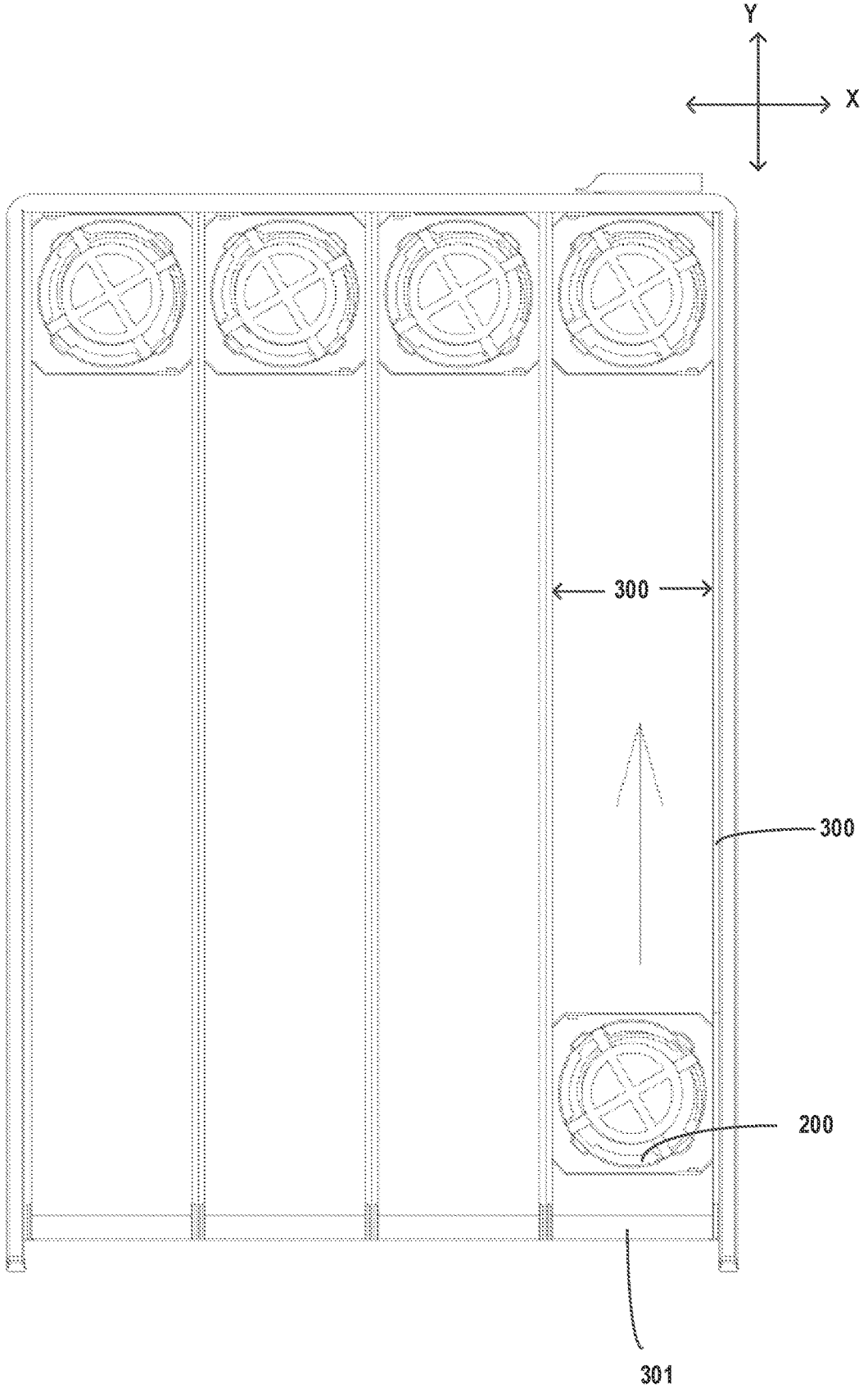
FIG. 9-FIG. 11 are schematic diagrams of a process in which an elastic module is mounted to the main body frame.
Figure 10:
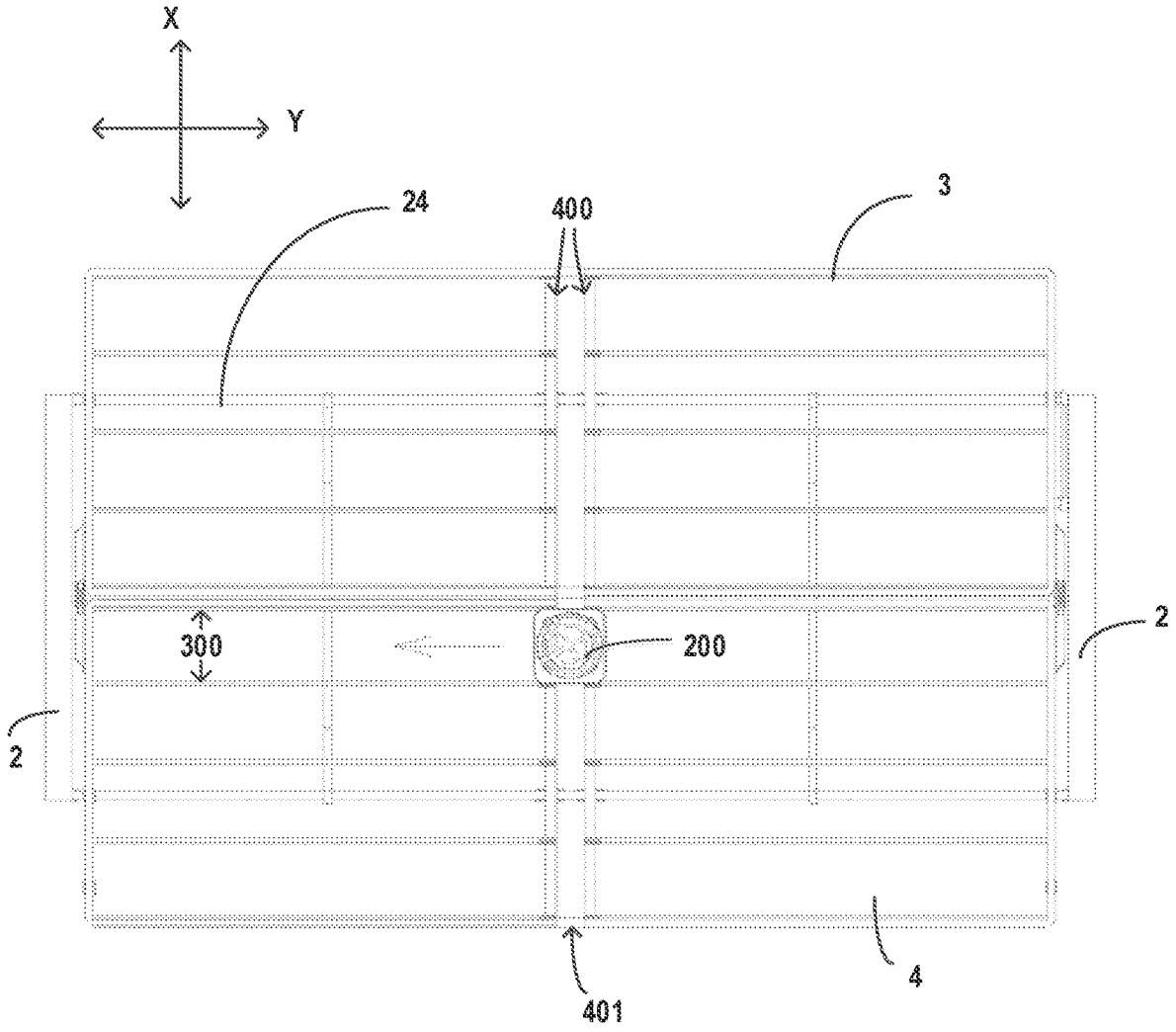
Figure 11:
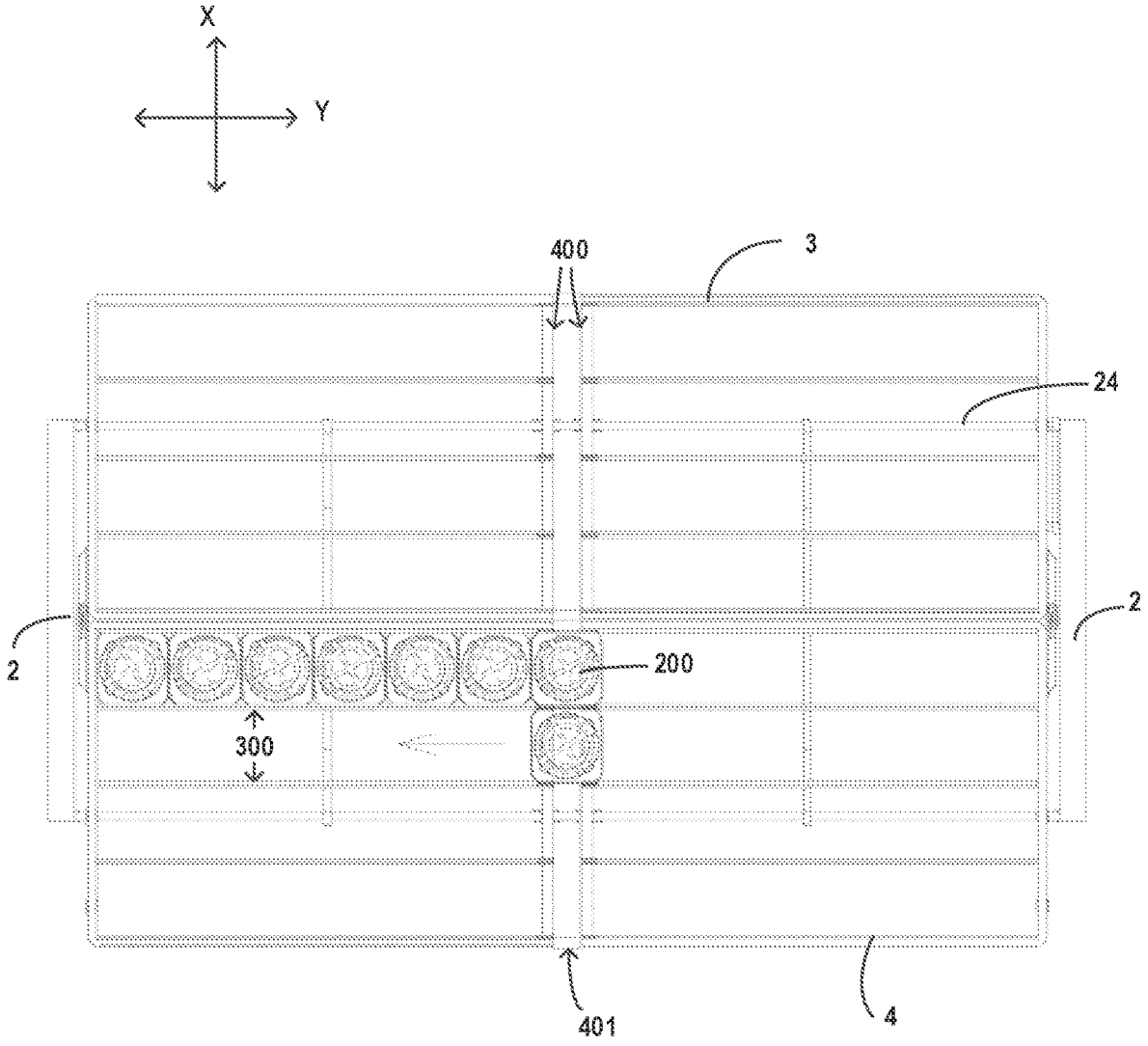
Figure 12:
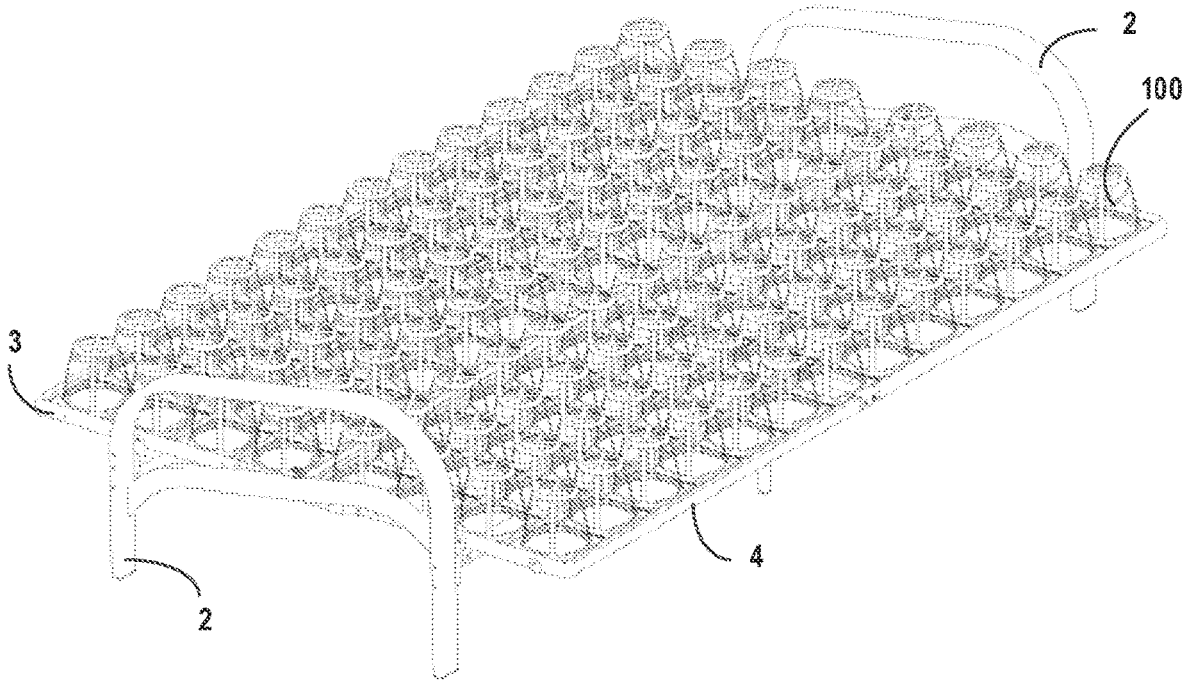
FIG. 12 is a schematic diagram after elastic modules are mounted on the main body frame.

Referring to FIG. 9 through FIG. 11, the main body frame is provided with slide rails (including a transverse slide rail 400 and longitudinal slide rails 300) which are configured in a way that a plurality of elastic modules 200 can be mounted on the main body frame from the outside of the main body frame and slide to a predetermined mounting position, so that a plurality of elastic modules 200 are closely arranged on a side of the main body frame facing the user (as shown in FIG. 12).

Preferably, the conical spring is mounted in the spring bracket with a predetermined initial compression force.

For example, referring to FIG. 9, the plurality of slide rails includes longitudinal slide rails 300, the longitudinal ends 301 of which are open, so that the elastic modules 200 can be received. Alternatively, the plurality of slide rails includes transverse side rails 400 whose transverse ends 401 are open so that the elastic modules 200 can be received.

Referring to FIG. 10 and FIG. 11, the plurality of slide rails include a plurality of longitudinal slide rails 300 extending in the longitudinal direction and a transverse slide rail 400 extending in the transverse direction. The longitudinal slide rails and transverse slide rails communicate at their intersections to facilitate the elastic modules 200 to switch side rails. Specifically, the transverse slide rail 400 is disposed in the middle of the longitudinal direction Y of the main body frame, and the transverse end 401 of the transverse slide rail 400 is opened to receive the elastic module 200 from the outside of the main body frame. The arrangement of the plurality of slide rails are designed such that the plurality of elastic modules 200 can enter the transverse slide rail 400 on the main body frame from the end of the main body frame, and switch to the longitudinal slide rails 300 at the intersection of the transverse slide rails 400 and the longitudinal slide rail 300.

Figure 13:
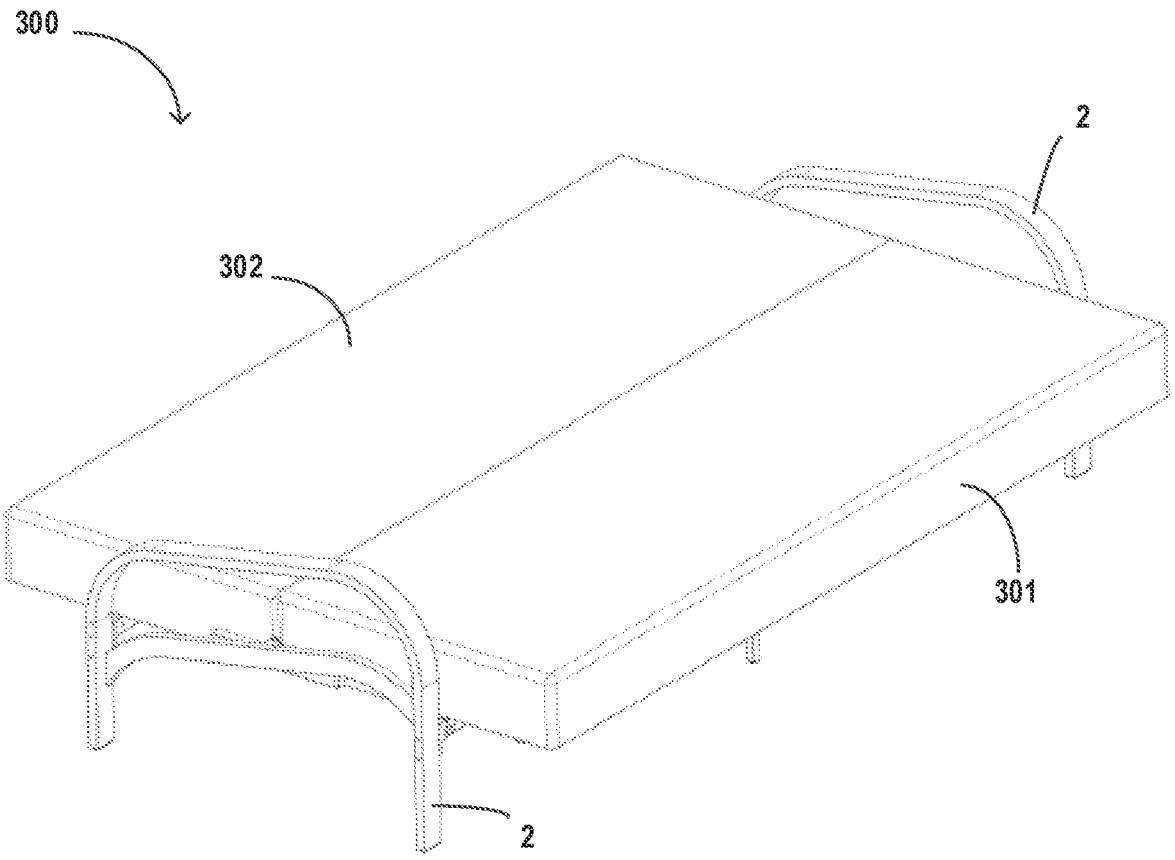
FIG. 13 and FIG. 14 are respective schematic diagrams showing shapes of a finished product of the sofa bed.
Figure 14:
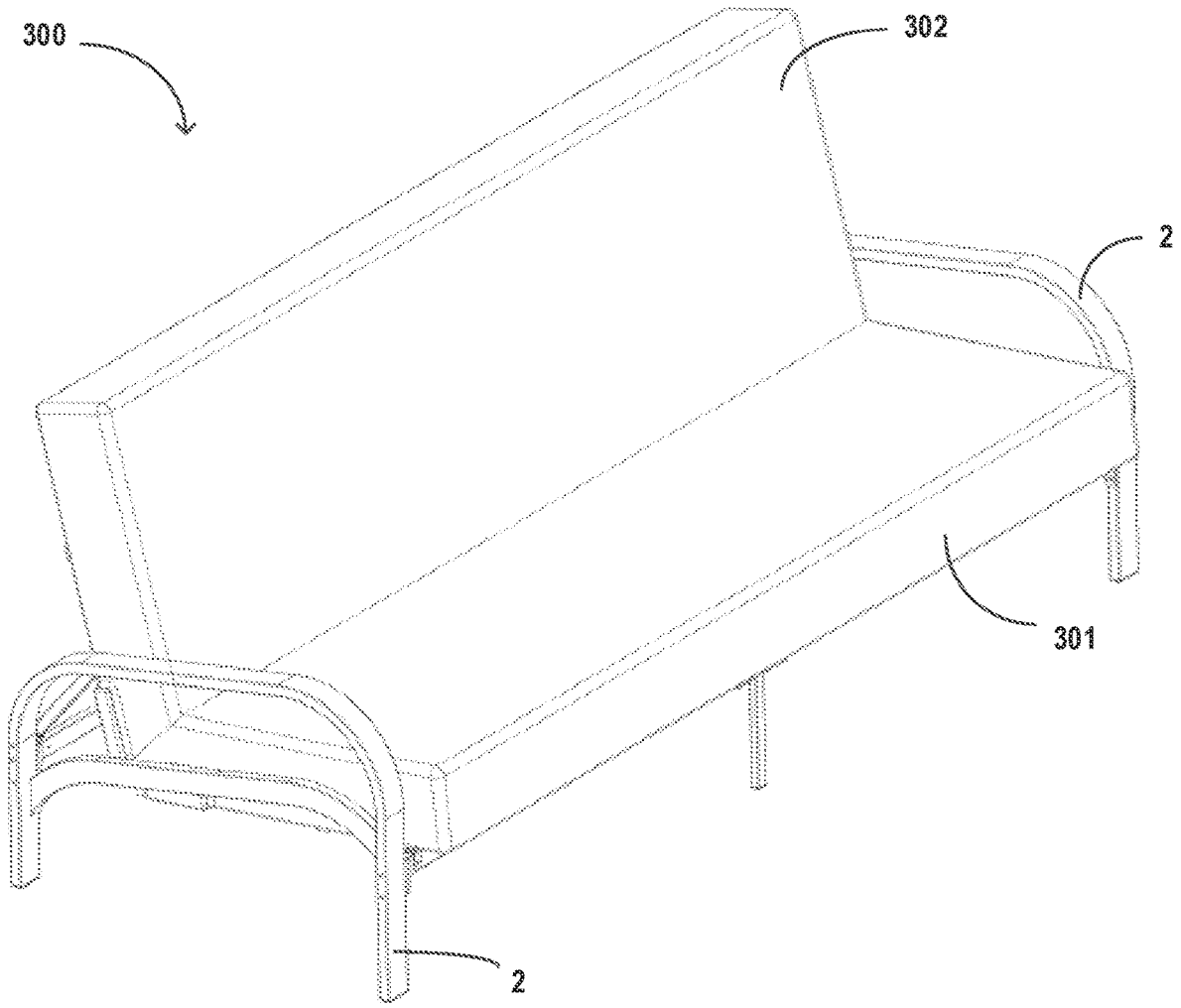

In a state that a plurality of elastic modules 200 are closely arranged on the side of the main body frame facing the user as shown in FIG. 12, an outer covering may be further provided on the elastic modules to obtain a sofa bed finished product as shown in FIG. 13 and FIG. 14. FIG. 13 shows a configuration of the sofa bed finished product as a bed; FIG. 14 shows a configuration of the sofa bed finished product as a sofa.

The above depictions of various embodiments of the present invention are provided to those having ordinary skill in the art for depiction purpose, and are not intended to exclude other embodiments from the present prevention or limit the present prevention to a single disclosed embodiment. As described above, various alternatives and modifications of the present prevention will be apparent to those of ordinary skill in the art. Accordingly, although some alternative embodiments have been described in detail, those having ordinary skill in the art will understand or readily develop other embodiments. The invention is intended to cover all alternatives, modifications and variations of those described herein, as well as other embodiments falling within the spirit and scope of the present prevention described herein.

I claim:

1. A sofa bed, comprising:

a plurality of elastic modules, each comprising a conical spring and a spring bracket configured to receive the conical spring;

a body frame comprising a plurality of longitudinal supporting members arranged to intersect perpendicularly a plurality of transverse supporting members;

armrest frames at opposite sides of the body frame;

each supporting member having a slide rail configured to engage with a bottom portion of a corresponding spring bracket with the plurality of elastic modules arranged to slide on the slide rails;

each longitudinal supporting member having a longitudinal slide rail;

each transverse supporting member having a transverse slide rail;

the longitudinal slide rails intersecting the transverse slide rails to allow the elastic modules to be moved longitudinally and transversely on the body frame;

the elastic modules mountable onto the body frame via an open end of one or more of the longitudinal or transverse slide rails.

2. The sofa bed of claim 1, wherein the spring bracket of each of the plurality of elastic modules comprises a base having a spring mounting seat, the spring mounting seat having a spring fixing part for fixing a first end of the conical spring.

3. The sofa bed of claim 2, wherein the spring bracket of each of the plurality of elastic module further comprises:

an end cover on a second end of the conical spring; and a plurality of flexible straps between the spring mounting seat and the end cover, the flexible straps disposed outside the conical spring.

4. The sofa bed of claim 2, wherein each of the plurality of elastic modules further comprises a covering wrapping the conical springs of the plurality of elastic module.

5. The sofa bed of claim 1, wherein the conical spring is mounted within the spring bracket in a predetermined initial compressive force.

6. The sofa bed of claim 1, wherein each longitudinal slide rail has an open end configured to receive the elastic modules.

7. The sofa bed of claim 1, wherein each transverse slide rail has an open end configured to receive the elastic modules.

8. The sofa bed of claim 1, wherein the transverse slide rails are disposed in a middle of the body frame in the longitudinal direction the transverse slide rails having open ends configured to receive the elastic modules from outside of the body frame, and then be moved into engagement with longitudinal slide rails at one of the intersections of the transverse slide rails and the longitudinal slide rails.

9. The sofa bed of claim 1 wherein the body frame comprises a seat portion and a backrest portion disposed adjacent to each other, the seat portion and the backrest portion configured to be folded or unfolded around a locking mechanism so that the body frame is changed between a bed configuration and a sofa configuration;

each of the armrest frames has a slideway to guide movement of the locking mechanism;

wherein locking mechanism is configured to lock the backrest portion relative to the seat portion in a predetermined angle (a) when the backrest portion and the seat portion are pivoted relative to each other around the locking mechanism, and the armrest frames are connected via the locking mechanism to the body frame so that a part of the locking mechanism can drive the body frame to displace guided by the slideway in a locked state.

10. The sofa bed of claim 9, wherein the locking mechanism comprises:

a seat portion connecting rod attached to a transverse edge of the seat portion and extending along the transverse edge;

a backrest portion connecting rod attached to a transverse edge of the backrest portion located at the same side as the transverse edge of the seat portion and extending along the transverse edge of the backrest portion; and a pivot connecting the seat portion connecting rod and the backrest portion connecting rod so that the backrest portion and the seat portion are caused to pivot relative to each other.

11. The sofa bed of claim 10, wherein the body frame is configured to release locking between the seat portion connecting rod and the backrest portion connecting rod when the seat portion is operated in a locked state to pivot towards the backrest portion.

12. The sofa bed of claim 11, wherein one of the seat portion connecting rod and the backrest portion connecting rod is provided with a ratchet, and the other of the seat portion connecting rod and the backrest portion connecting rod is provided with a pawl, wherein the ratchet and the pawl cooperate with each other to lock the backrest portion relative to the seat portion in a predetermined angle.

13. The sofa bed of claim 12, wherein the ratchet is provided at an outer edge with a recess recessed inwards in a radial direction of the ratchet (and the pawl is provided with a protrusion corresponding with the recess, wherein the protrusion is configured to engage with the recess when the backrest portion is set at the predetermined angle relative to the seat portion, thereby locking the backrest portion and the seat portion.

14. The sofa bed of claim 9, wherein the seat portion and the backrest portion are all of a rectangular structure.

15. The sofa bed of claim 14, wherein a side of the seat portion extending in the longitudinal direction is disposed adjacent to a side of the backrest portion extending in the longitudinal direction.

16. The sofa bed of claim 9, wherein the body frame is configured to lock the backrest portion relative to the seat portion in a plurality of different predetermined angles.

17. The sofa bed of claim 9, wherein the body frame further comprises a driven beam having a first end pivotally connected to the armrest frame and a second end pivotally connected to the backrest portion.

18. The sofa bed of claim 9, wherein the armrest frame comprises an armrest frame body substantially of a U-shape and a reinforcement transverse beam connected between two legs of the armrest frame body, wherein the slideway is formed on the reinforcement transverse beam.

19. The sofa bed of claim 18, wherein the locking mechanism is provided with a pin extending towards the outside of the body frame, the slideway is a sliding groove formed on the reinforcement transverse beam having a first end positioned higher than a second end of the slideway, and the first end is opened towards an upper side edge of the armrest frame to receive the pin.

20. The sofa bed of claim 19, wherein the reinforcement transverse beam has a channel-shaped cross section and an outer end of the pin is provided with a protrusion fitting with the channel-shaped cross section of the transverse beam.

21. The sofa bed of claim 18, wherein the reinforcement transverse beam is provided with a slide rod, and the locking mechanism is provided with a slide sleeve configured to journal on the slide rod and slide along the slide rod.

22. The sofa bed of claim 18, wherein a slide rod is provided under the reinforcement transverse beam, and the slide rod and a lower edge of the reinforcement transverse beam jointly define a sliding groove.

23. The sofa bed of claim 9, wherein the sofa bed comprises a bottom support structure supported below the backrest portion and the seat portion and connected fixedly to the two armrest frames.

24. A sofa bed, comprising:

a plurality of spring modules, each spring module comprising a conical spring and a spring bracket;

a body frame comprising a first plurality of longitudinal slide rails and a second plurality of transverse slide rails perpendicular to and intersecting the longitudinal slide rails, to allow the spring modules to be moved longitudinally and transversely on the body frame;

the spring bracket of each spring module configured to slidably engage with an adjacent pair of longitudinal slide rails or traverse slide rails; and first and second armrest frames at first and second ends of the body frame, respectively.

* * * * *